United States Patent [19]

Koch

[11] 4,029,587

[45] June 14, 1977

[54] LUBRICANTS AND FUNCTIONAL FLUIDS CONTAINING SUBSTITUTED SULFOLANES AS SEAL SWELLING AGENTS

[75] Inventor: Frederick William Koch, Willoughby Hills, Ohio

[73] Assignee: The Lubrizol Corporation, Cleveland, Ohio

[22] Filed: June 23, 1975

[21] Appl. No.: 589,309

[52] U.S. Cl. ..... 252/48.2; 252/72; 252/78.1

[51] Int. Cl.[2] ..... C10M 1/38

[58] Field of Search ..... 252/48.2, 72, 78

[56] References Cited

UNITED STATES PATENTS

| | | | |
|---|---|---|---|
| 2,219,006 | 10/1940 | Delfs | 252/48.2 X |
| 2,461,339 | 2/1949 | Morris et al. | 252/48.2 X |
| 2,465,912 | 3/1949 | Morris et al. | 252/48.2 X |
| 2,483,219 | 9/1949 | Morris et al. | 252/48.2 X |
| 2,492,927 | 12/1949 | Ballard et al. | 252/48.6 X |
| 3,250,717 | 5/1966 | Lambert et al. | 252/48.2 X |
| 3,407,140 | 10/1968 | Chiddix et al. | 252/48.2 X |

*Primary Examiner*—Delbert E. Gantz
*Assistant Examiner*—Andrew H. Metz
*Attorney, Agent, or Firm*—James W. Adams, Jr.; William H. Pittman

[57] ABSTRACT

Compositions useful as lubricants and functional fluids comprise an oleaginous liquid of lubricating viscosity, typically a mineral oil, and a 3-alkoxysulfolane or the like, in which the alkoxy group contains at least about 4 and preferably about 4–25 carbon atoms, as a seal swelling agent.

14 Claims, No Drawings

LUBRICANTS AND FUNCTIONAL FLUIDS CONTAINING SUBSTITUTED SULFOLANES AS SEAL SWELLING AGENTS

This invention relates to new compositions of matter suitable for causing swelling of seals in machinery. More particularly, it relates to compositions comprising an oleaginous liquid of lubricating viscosity and a substituted sulfolane of the formula

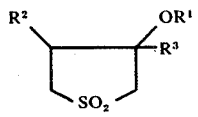

wherein $R^1$ is a hydrocarbon-based radical having at least about 4 carbon atoms and each of $R^2$ and $R^3$ is hydrogen or a lower alkyl-based radical.

The problem of shrinkage of seals, particularly elastomeric seals, in machinery (e.g., automatic transmissions for motor vehicles) upon contact with functional fluids is of considerable importance since such shrinkage causes leakage of the functional fluid which can lead to defective operation of the machinery, or failure to operate at all. (The term "functional fluid", as used herein, means a fluid involved in the transmission of energy, such as a lubricant, hydraulic fluid, automatic transmission fluid, heat exchange medium or the like.) To eliminate this problem, it is conventional to include in the functional fluid an additive whose presence therein causes the seal to swell. A number of such additives are known in the art, but their use has several disadvantages. For example, many of them are toxic. Moreover, they must often be used in undesirably large quantities in the functional fluid.

A principal object of the present invention, therefore, is to provide new compositions of matter capable of swelling or minimizing shrinkage of seals used in machinery.

A further object is to provide seal-swelling lubricants and functional fluids which contain relatively non-toxic additives.

A further object is to provide lubricants and functional fluids containing extremely small but effective quantities of seal swelling additives.

Other objects will in part be obvious and will in part appear hereinafter.

As previously noted, the compositions of this invention comprise two components of which the first is an oleaginous liquid of lubricating viscosity. Such liquids include natural and synthetic oils and mixtures thereof, especially oils of the type useful as crankcase lubricating oils for spark-ignited and compression-ignited internal combustion engines, including automobile and truck engines, two-cycle engines, aviation piston engines, marine and railroad diesel engines, as well as gas engines, jet aircraft turbines, stationary power engines and turbines and the like. Base liquids for automatic transmission fluids, transaxle lubricants, gear lubricants, metal-working lubricants, hydraulic fluids and other lubricating oil and grease compositions are also useful for this purpose.

Natural oils include animal oils and vegetable oils (e.g., castor oil, lard oil) as well as liquid petroleum oils and solvent-treated or acid-treated mineral lubricating oils of the paraffinic, naphthenic or mixed paraffinic-naphthenic types; such mineral oils are preferred. Oils of lubricating viscosity derived from coal or shale are also useful.

Synthetic lubricating oils include hydrocarbon oils and halo-substituted hydrocarbon oils such as polymerized and interpolymerized olefins [e.g., polybutylenes, polypropylenes, propylene-isobutylene copolymers, chlorinated polybutylenes, poly(1-hexenes), poly(1-octenes), poly(1-decenes), etc., and mixtures thereof]; alkylbenzenes (e.g., dodecylbenzenes, tetradecylbenzenes, dinonylbenzenes, di-(2-ethylhexyl)benzenes, etc.); polyphenyls (e.g., biphenyls, terphenyls, alkylated polyphenyls, etc.), alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic oils. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters, mixed $C_3$–$C_8$ fatty acid esters, esters, or the $C_{13}$ Oxo acid diester of tetraethylene glycol.

Another suitable class of synthetic oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers silicate, as neopentyl glycol, trimethylolpropane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic oils [e.g., tetraethyl silicated, tetraisopropyl silicate, tetra-(2-ethylhexyl) silicate, tetra-(4-methyl-2-ethylhexyl) silicate, tetra-(p-tert-butylphenyl) silicate, hexyl(4-methyl-2-pentoxy)disiloxane, poly(methyl)siloxanes, poly(-methylphenyl)siloxanes, etc.]. Other synthetic oils include liquid esters of phosphorus-containing acids (e.g., tricresyl phosphate, trioctyl phosphate, diethyl ester of decylphosphonic acid, etc.), polymeric tetrahydrofurans and the like.

Unrefined, refined and rerefined oils (and mixtures of each with each other) of the type disclosed hereinabove can be used in the compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, acid or base extraction, filtration, percolation, etc. Rerefined oils are obtained by processes similar to those used to obtain refined oils applied to refined oils which have been already used in service. Such refined oils are also known as reclaimed or reprocessed oils and often are additionally processed by techniques directed to removal of spent additives and oil breakdown products.

The substance which serves as a seal swelling component in the compositions of this invention is a substituted sulfolane having the above formula. (When used herein, the singular form "a", "an" and "the" include the plural unless the context clearly dictates otherwise; thus, for example, "a compound" includes a mixture of compounds.) In the formula, $R^1$ is a hydrocarbon-based radical having at least about 4 carbon atoms. The term "hydrocarbon-based radical", when used herein, denotes a radical having a carbon atom directly attached to the remainder of the molecule and having predominantly hydrocarbon character within the context of this invention. Such radicals include the following:

1. Hydrocarbon radicals; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic radicals, and the like. Such radicals are known to those skilled in the art; examples include butyl, pentyl, hexyl, octyl, decyl, dodecyl, eicosyl, decenyl, cyclohexyl, phenyl, tolyl, heptylphenyl, isopropenylphenyl and naphthyl (all isomers of such radicals being included when more than one isomer is possible).

2. Substituted hydrocarbon radicals; that is, radicals containing non-hydrocarbon substituents which, in the context of this invention, do not alter the predominantly hydrocarbon character of the radical. Those skilled in the art will be aware of suitable substituents; examples are halo, nitro, cyano, RO-,

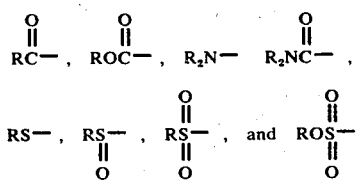

(R being hydrogen or a hydrocarbon radical).

3. Hetero radicals; that is, radicals which, while predominantly hydrocarbon in character within the context of this invention, contain atoms other than carbon present in a chain or ring otherwise composed of carbon atoms. Suitable hetero atoms will be apparent to those skilled in the art and include, for example, oxygen, nitrogen and sulfur.

In general, no more than about three substituents or hetero atoms, and preferably no more than one, will be present for each 10 carbon atoms in the hydrocarbon-based radical.

Terms such as "alkyl-based radical" and the like have meanings analogous to the above with respect to alkyl radicals and the like.

The preferred substituted sulfolanes are those in which $R^1$ is a hydrocarbon radical, usually one which is free from acetylenic unsaturation and which contains about 4–100 carbon atoms. Examples (all isomers being included) are butyl, amyl, hexyl, octyl, decyl, dodecyl, eicosyl, triacontanyl, butenyl, dodecenyl, phenyl, naphthyl, tolyl, dodecylphenyl, tetrapropene-alkylated phenyl, phenethyl, cyclohexyl and methylcyclohexyl. Alkyl radicals having about 4–25 and usually about 4–10 carbon atoms are especially preferred.

Each of $R^2$ and $R^3$ is hydrogen or a lower alkylbased (and usually a lower alkyl) radical, the word "lower" denoting radicals containing up to 7 carbon atoms. Examples of lower alkyl radicals (all isomers being included, but especially the straight chain radicals) are methyl, ethyl, propyl, butyl and hexyl, with methyl being preferred. Most often, one of $R^2$ and $R^3$ is hydrogen and the other (usually $R^3$) is hydrogen or methyl. Both are preferably hydrogen.

The preferred substituted sulfolanes for use in the compositions of this invention are those in which $R^2$ and $R^3$ are hydrogen and $R^1$ is either the isodecyl radical or a combination of the isobutyl radical with a mixture of primary amyl radicals, the isobutyl material comprising about 25–75% (by weight) of said combination.

The above-described substituted sulfolanes comprise a class of compounds which is known in the art. They may be prepared by the reaction of 3-sulfolene or a substituted derivative thereof with an organic hydroxy compound, ordinarily an alcohol. This method for their preparation is described, for example, in U.S. Pat. No. 2,393,925, and in Data Sheet DS-58:3 of Shell Development Company entitled "3-Sulfolene". The 3-sulfolenes may be prepared by reaction of sulfur dioxide with a conjugated diene such as butadiene or isoprene.

The compositions of this invention which are useful as functional fluids contain a minor amount of substituted sulfolane effective to cause swelling of seals. That amount is usually about 0.05–20.0 parts (by weight), preferably about 0.1–5.0 parts, per 100 parts of oil. However, the invention includes additive concentrates comprising a diluent (typically an oleaginous liquid of lubricating viscosity) and the substituted sulfolane, the latter comprising up to about 90% of the weight of the concentrate. Such concentrates may be diluted with the oleaginous liquids as described hereinabove, as is well known in the art, to produce functional fluids.

The present invention also contemplates functional fluids and concentrates containing other additives in combination with the substituted sulfolane. Such additives include, for example, detergents and dispersants of the ash-containing or ashless type, corrosion- and oxidation-inhibiting agents, pour point depressing agents, extreme pressure agents, viscosity index improvers, color stabilizers and anti-foam agents.

The ash-containing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

The term "basic salt" is used to designate metal salts wherein the metal is present in stoichiometrically larger amounts than the organic acid radical. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature above 50° C. and filtering the resulting mass. The use of a "promoter" in the neutralization step to aid the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, carbitol, ethylene glycol, stearyl alcohol, and cyclohexyl alcohol; and amines such as aniline, phenylenediamine, phenothiazine, phenyl-$\beta$-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°–200° C.

Ashless detergents and dispersants are illustrated by the interpolymers of an oil-solubilizing monomer, e.g., decyl methacrylate, vinyl decyl ether, or high molecular weight olefin, with a monomer containing polar substituents, e.g., aminoalkyl acrylate or poly-(oxyethylene)substituted acrylate; the amine salts, amides, and imides of oil-soluble monocarboxylic or dicarboxylic acids such as stearic acid, oleic acid, tall oil acid, and high molecular weight alkyl or alkenyl-substituted succinic acid. Especially useful as ashless detergents are the acylated polyamines and similar nitrogen compounds containing at least about 54 carbon atoms as described in U.S. Pat. No. 3,272,746; reaction products of such compounds with other reagents including boron compounds, phosphorus compounds, epoxides, aldehydes, organic acids and the like; and esters of hydrocarbon-substituted succinic acids as described in U.S. Pat. No. 3,381,022.

Extreme pressure agents and corrosion-inhibiting and oxidation-inhibiting agents are exemplified by chlorinated aliphatic hydrocarbons such as chlorinated wax; organic sulfides and polysulfides such as benzyl disulfide, bis(chlorobenzyl) disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate; phosphorus esters including principally dihydrocarbon and trihydrocarbon phosphites such as dibutyl phosphite, diheptyl phosphite, dicyclohexyl phosphite, pentyl phenyl phosphite, dipentyl phenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

Typical compositions according to this invention are listed in the following table. All amounts other than those for mineral oil are exclusive of oil used as diluent. The substituted sulfolanes are those of the above structural formula wherein $R^1$ is as listed and $R^2$ and $R^3$ are each hydrogen.

| Ingredient | Parts by weight | | | |
|---|---|---|---|---|
| | A | B | C | D |
| Mineral oil (SAE 10W-40 base) | — | — | 90.29 | 85.83 |
| Mineral oil (automatic transmission fluid base) | 92.91 | 94.95 | — | — |
| Substituted sulfolane, $R^1$ = isodecyl | — | 0.50 | 2.00 | 2.00 |
| Substituted sulfolane, $R^1$ = mixture of isobutyl and primary amyl | 1.00 | — | — | — |
| Reaction product of ethylene polyamine with polyisobutenyl succinic anhydride | 3.09 | 1:71 | — | — |
| Borated reaction product of ethylene polyamine with polyisobutenyl succinic anhydride | 0.68 | 0.67 | 0.74 | — |
| Pentaerythritol ester of polyisobutenyl succinic acid | — | — | — | 2.35 |
| Reaction product of pentaerythritol and ethylene polyamine with polyisobutenyl succinic anhydride | — | — | 2.30 | — |
| Basic calcium petroleum sulfonate | — | — | — | 0.75 |
| Tetrapropenyl succinic acid | — | — | 0.34 | — |
| Zinc isooctylphosphorodithioate | 0.66 | — | — | — |
| Zinc salt of mixed isobutyl- and prim-amylphosphorodithioic acids | — | — | — | 1.32 |
| Dialkyl ($\beta$-hydroxy-$C_{14-16}$ alkyl) phosphonate | 0.13 | — | — | — |
| Phenyl $C_{14-18}$ dialkyl phosphite | — | 0.20 | — | — |
| N-tallow diethanolamine | 0.10 | — | — | — |
| N-dodecyl dipropanolamine | 0.04 | — | — | — |
| Diphenylamine-based antioxidant | 0.20 | 0.20 | — | — |
| Hindered phenol antioxidant | — | — | 0.50 | — |
| Sulfurized alkyl cyclohexenecarboxylate | — | — | 1.33 | — |
| Sulfurized fatty ester-fatty acid-olefin mixture | — | 0.30 | — | — |
| Hydroxypropylated $C_{12}$ mercaptan | — | 0.30 | — | — |
| Styrene-butadiene copolymer | — | — | 2.50 | — |
| Styrene-alkyl maleate copolymer | 1.19 | 1.17 | — | — |
| Polyacrylate viscosity index improver | — | — | — | 7.75 |
| Silicone anti-foam agent | 0.02 | 0.02 | 0.01 | 0.01 |

What is claimed is:

1. A composition comprising a major amount of an oleaginous liquid of lubricating viscosity and a minor amount, effective to cause swelling of seals in machinery, of a substituted sulfolane of the formula

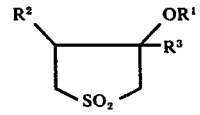

wherein $R^1$ is a hydrocarbon radical having at least about 4 carbon atoms and each of $R^2$ and $R^3$ is hydrogen or a lower alkyl radical.

2. A composition according to claim 1 wherein $R^2$ and $R^3$ are hydrogen.

3. A composition according to claim 2 wherein $R^1$ is an alkyl radical having about 4–25 carbon atoms.

4. A composition according to claim 3 wherein the oleaginous liquid is a mineral oil.

5. A composition according to claim 4 wherein $R^1$ is the isodecyl radical.

6. A composition according to claim 4 wherein $R^1$ is a mixture of the isobutyl and primary amyl radicals.

7. A composition according to claim 3 wherein the oleaginous liquid is a synthetic oil.

8. An additive concentrate comprising an oleaginous liquid of lubricating viscosity and up to about 90% by weight of a substituted sulfolane of the formula

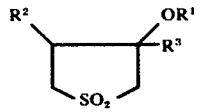

wherein $R^1$ is a hydrocarbon radical having at least about 4 carbon atoms and each of $R^2$ and $R^3$ is a lower alkyl radical; the amount of said substituted sulfolane in said concentrate being sufficient to afford, when said concentrate is further diluted with an oleaginous liquid of lubricating viscosity, a composition according to claim 1.

9. A concentrate according to claim 8 wherein $R^2$ and $R^3$ are hydrogen.

10. A concentrate according to claim 9 wherein $R^1$ is an alkyl radical having about 4–25 carbon atoms.

11. A concentrate according to claim 10 wherein the oleaginous liquid is a lubricating oil.

12. A concentrate according to claim 11 wherein $R^1$ is the isodecyl radical.

13. A concentrate according to claim 11 wherein $R^1$ is a mixture of the isobutyl and primary amyl radicals.

14. A composition comprising a major amount of a lubricating oil and a minor amount, effective to cause swelling of seals in machinery, of 3-isodecoxysulfolane.

* * * * *